US010081999B2

(12) United States Patent
Lv et al.

(10) Patent No.: US 10,081,999 B2
(45) Date of Patent: Sep. 25, 2018

(54) DOWNHOLE OCCLUDER, PRESSURIZED SUCKER ROD AND OPERATION TECHNIQUE TO REPAIR OIL PIPES

(71) Applicant: KARAMAY SHENGLI PLATEAU MACHINERY LIMITED COMPANY, Karamay, Xinjiang (CN)

(72) Inventors: Xiangsheng Lv, Xinjiang (CN); Gangyao Li, Xinjiang (CN); Zhongxiang Zhao, Xinjiang (CN); Haijun Luan, Xinjiang (CN); Yimin Zhang, Xinjiang (CN); Junfeng Lv, Xinjiang (CN); Tingde Feng, Xinjiang (CN)

(73) Assignee: KARAMAY SHENGLI PLATEAU MACHINERY LIMITED COMPANY, Xinjiang (CN)

( * ) Notice: Subject to any disclaimer, the term of this patent is extended or adjusted under 35 U.S.C. 154(b) by 0 days.

(21) Appl. No.: 15/608,581

(22) Filed: May 30, 2017

(65) Prior Publication Data

US 2017/0328169 A1 Nov. 16, 2017

Related U.S. Application Data

(63) Continuation of application No. PCT/CN2016/093012, filed on Aug. 3, 2016.

(30) Foreign Application Priority Data

May 11, 2016 (CN) ..... 2016 1 0306700

(51) Int. Cl.
*E21B 33/12* (2006.01)
*E21B 17/10* (2006.01)

(52) U.S. Cl.
CPC ..... *E21B 33/1208* (2013.01); *E21B 17/1071* (2013.01)

(58) Field of Classification Search
CPC ..... E21B 33/1208; E21B 17/1071
See application file for complete search history.

(56) References Cited

U.S. PATENT DOCUMENTS 3,208,527 A * 9/1965 Bayless ..... E21B 34/14 166/106

FOREIGN PATENT DOCUMENTS

CN 2476640 Y 2/2002

OTHER PUBLICATIONS

PCT Search Report—PCT/CN2016/093012 dated Jan. 23, 2017 citing to CN2476640 dated Feb. 13, 2002.

* cited by examiner

*Primary Examiner* — D. Andrews
*Assistant Examiner* — Kristyn A Hall
(74) *Attorney, Agent, or Firm* — Troutman Sanders LLP

(57) ABSTRACT

A downhole occluder for oil wells includes a sealing socket and a positioning flange with sealing surfaces set up inside an oil pipe. An oil sucker rod pump is installed inside the tubular column which mounts on top of the sealing socket. A sealing surface of a sealing flange on the rod pump mounts with a sealing surface of the sealing socket on the tubular column. Outer oil inlet borings are placed at the wall of oil tubular column underneath the positioning flange. An inner pipe is installed inside this section of tubular column. Place inner oil inlet borings on the inner pipe wall corresponding to outer oil inlet borings on the tubular column. Sealing grooves are placed underneath the inner oil inlet borings on the inner pipe wall. Sealing rings are placed in the sealing grooves to seal the inner wall of tubular column.

3 Claims, 2 Drawing Sheets

DOWNHOLE OCCLUDER, PRESSURIZED SUCKER ROD AND OPERATION TECHNIQUE TO REPAIR OIL PIPES

CROSS REFERENCE TO RELATED PATENT APPLICATIONS

This is a U.S. continuation of International Patent Application No. PCT/CN2016/093012, filed Aug. 3, 2016, which claims benefit of priority to Chinese Patent Application No. CN201610306700.2, filed May 11, 2016. The entire contents of these applications are hereby incorporated by reference.

TECHNICAL FIELD

This invention relates to operation tools for oil well and pipes. It is a device to seal the oil pipe and isolate the pressure from inside and outside of the pipe, and more particularly a downhole occluder, pressurized sucker rod and techniques to repair oil pipes.

BACKGROUND

During the operation or the maintenance of all kinds of oil well, such as oil well, water well and gas injection well, it is sometimes required to seal the pipes to isolate the pressure inside and outside the pipes. For example:

1. Prior to a well maintenance, the bottom end of oil pipe is to be occluded to avoid material under the well to spray out, which will lead to energy waste, environmental pollution or accident. Currently, there is no similar product that meets the requirement. At current practice, well killing fluid is used to be filled into oil pipe to restrict the pressure underneath the well. It is time consuming and costly.

2. In rod-type pump oil production well, the bottom of the pipe needs to be occluded before it is pumped and pressurized to test the sealability of all connection joints in tubular column. There is no such product in the market nowadays. Sucker rod pump and sucker rod string are to be placed to the bottom of pipe before the pipe is pressurized. In case of any leakage, the sucker rod string will have to be removed, then tubular column is removed, resulting in repeated labor.

SUMMARY

This invention is to provide a downhole occluder, pressurized sucker rod and techniques to maintain and repair oil pipes in oil well. The structure is simple, reasonable and reliable to provide a safe, highly efficient, environmental and energy saving method to repair and maintain pressurized sucker rod and oil pipes. It brings the convenience to repeatedly occlude the pressure under the well to result in a safe, highly efficient, environmental and energy saving production.

The purpose of this invention is achieved through: a downhole occluder, pressurized sucker rod and techniques to repair oil pipes. Sealing socket and positioning flange with sealing surfaces are installed inside tubular column. Install sucker rod pump inside the tubular column, which mounts on top of sealing socket. The sealing surface of sealing flange on the sucker rod pump mounts with the sealing surface of sealing socket of tubular column. Outer oil inlet borings are placed on the wall of tubular column underneath positioning flange. Inner pipe is installed in this section of tubular column. On the inner pipe wall, set up the inner oil inlet borings that are corresponding to outer oil inlet borings on tubular column. Set up sealing grooves underneath the inner oil inlet borings on the inner pipe wall. Install sealing rings to the sealing grooves that seals the inside wall of tubular column. The top of inner pipe is connected to sucker rod pump through connecting coupler. The bottom end of tubular column is occluded.

Both top and bottom ends of the tubular column in this invention are connected to oil pipes. The bottom end of bottom pipe is occluded with a plug. A positioning flange is positioned inside the oil pipe that connects to the top of tubular column to restrict the inner pipe to move up. There is a sealing surface on top of positioning flange to seal with the sealing surface outside the sucker rod pump. Top of inner pipe is connected to bottom of connecting coupler. The bottom side of sucker rod pump is connected to top of connecting coupler.

Working principles of this invention:

1. When pumping the oil, the occluder is opened for the oil to flow into the tubular column. The borings on the inner pipe and tubular column are aligned for oil to flow in for pumping process.

2. Prior to well maintenance, inner pipe is lifted up so that the two sealing grooves on the inner pipe will keep the tubular column occluded. When the tubular column is isolated from outside and inside, test the sealability with pressure prior to well maintenance work, such as uplifting the oil pipe.

3. When installing tubular columns, keep occluder at sealed position. Once the tubular column is installed, test the sealability with pressure before installing the oil sucker rod string.

The positive effects of this invention:

1. When in an opened position, the passage is on the side of the tubular column without the restriction of its diameter. The passage area can be designed in a larger scale for smooth movement.

2. When in a sealed position, inner pipe is balanced vertically hence to provide a stable and reliable sealability.

3. This will provide a safe, highly efficient, environmental and energy saving production method.

The structure of this invention is simple, reasonable and reliable to provide a safe, highly efficient, environmental and energy saving method to repair and maintain pressurized sucker rod and oil pipes. It brings the convenience to repeatedly occlude the pressure under the well to result in a safe, highly efficient, environmental and energy saving production.

BRIEF DESCRIPTION OF THE DRAWINGS

This invention is described below with drawings.

DETAILED DESCRIPTION

Figure 1:
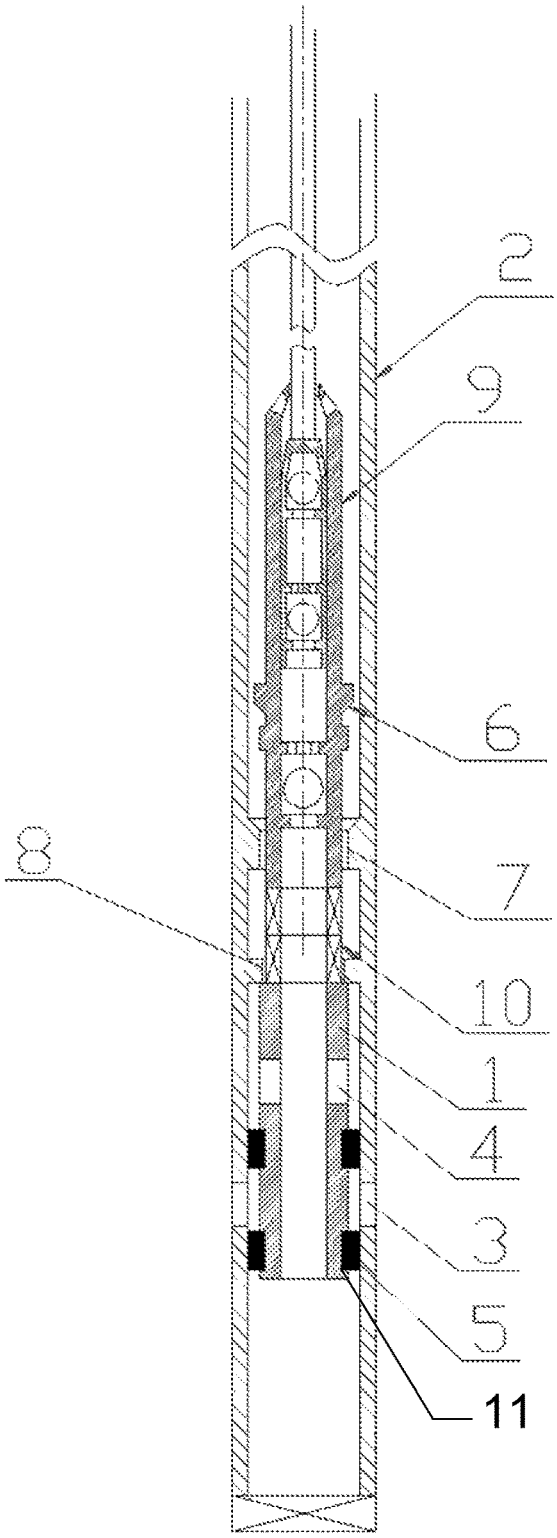
FIG. 1 is a schematic of present invention in sealed position.
Figure 2:
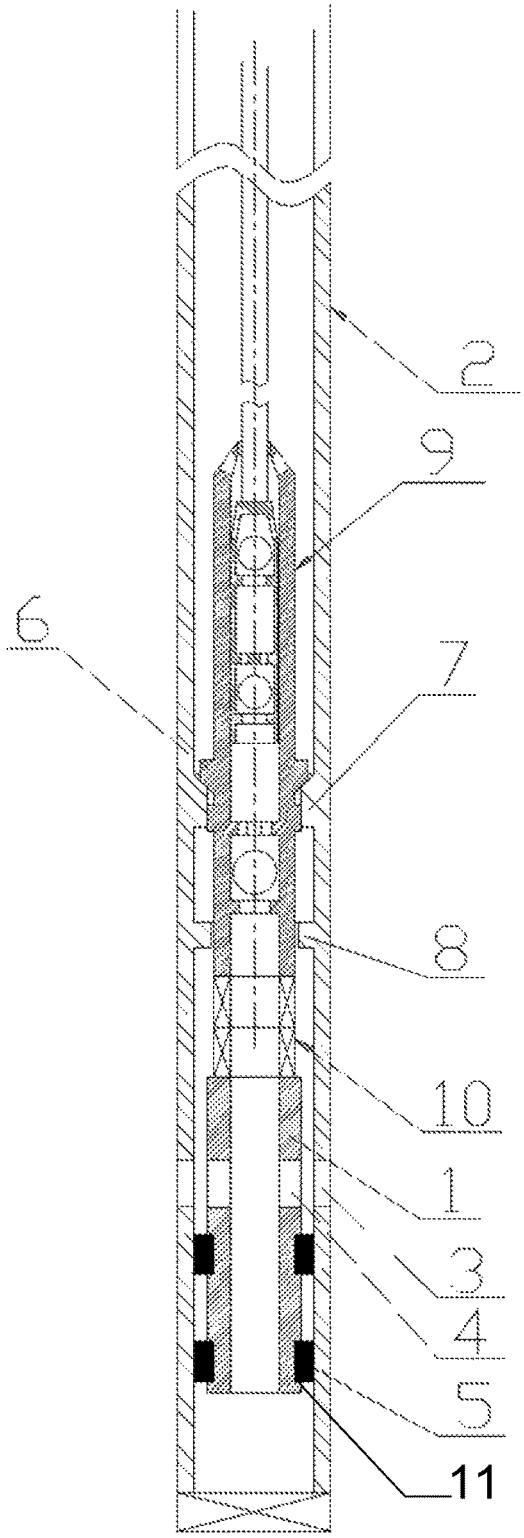
FIG. 2 is a schematic of present invention in opened position.

A downhole occluder, pressurized oil sucker rod and maintenance techniques for oil pipe are shown in FIGS. 1 and 2. Set up the sealing socket 7 and positioning flange 8 with sealing surfaces inside tubular column 2. Install sucker rod pump 9 inside tubular column 2, which mounts on top of sealing socket 7. The sealing surface of sealing flange 6 on the sucker rod pump 9 mounts with the sealing surface of sealing socket 7 of tubular column 2. Outer oil inlet borings 3 are placed on the wall of tubular column underneath positioning flange 8. Inner pipe 1 is installed in this section of tubular column. On the inner pipe 1 wall, set up the inner oil inlet borings 4 that are corresponding to outer oil inlet borings 3 on tubular column 2. Set up sealing grooves 11 underneath the inner oil inlet borings 4 on the inner pipe 1 wall. Install sealing rings 5 to the sealing grooves 11 that seal the inside wall of tubular column 2. The top of inner pipe 1 is connected to sucker rod pump 9 through connecting coupler 10. The bottom end of tubular column 2 is occluded. There are 1 to 5 sealing grooves 11. Sealing ring 5 is a flexible wear resistant sealing ring.

Installation procedure of tubular column and sucker rod string

1. Occlude the bottom of oil pipe with a plug. Connect top of inner pipe to the bottom of connecting coupler. Install inner pipe and sealing rings inside tubular column at sealed position. The bottom of pipe is now in sealed position. Maintenance work to the oil sucker rod can be carried out without pressurizing the well.

2. Place positioning flange, sealing surface and top connecting tubular column in place by sequence until the tubular column is installed.

3. Connect bottom of sucker rod pump to the top of connecting coupler. Install top of connecting coupler, sucker rod pump and sucker rod string in sequence.

4. When top of connecting coupler mounts with bottom section, continue to lower the sucker rod string until the sealing surface 1 of sucker rod pump touches the sealing surface 2 of tubular column. Sealing surface 2 restricts the position of sucker rod pump to keep both top and bottom sides of sucker rod string and oil pipe sealed. At the same time, inner pipe and sealing rings are pushed by sucker rod pump down to opened position.

5. Adjust the buffer setting to complete the installation of sucker rod string. Pumping process may start.

Above mentioned working process of sucker rod string is opposite to tubular column. When top of connecting coupler separates from the bottom section, inner pipe is lifted up to sealed position. Under such circumstance, bottom of the oil pipe is occluded. The maintenance work of sucker rod string can be carried out without pressurizing the well.

What is claimed is:

1. A method for maintaining oil pipes using a downhole occluder, pressurized sucker rod, comprising:

setting up a sealing socket and a positioning flange inside an oil tubular column;

installing a sucker rod pump on top of the sealing socket inside the tubular column, wherein a sealing surface of a sealing flange on the sucker rod pump mounts with a sealing surface of the sealing socket of the tubular column, wherein outer oil inlet borings are placed on a wall of the tubular column underneath the positioning flange, and wherein an inner pipe is installed in the tubular column underneath the positioning flange;

on a wall of the inner pipe, setting up inner oil inlet borings that correspond to the outer oil inlet borings on the tubular column;

setting up at least two sealing grooves underneath the inner oil inlet borings on the wall of the inner pipe;

installing sealing rings to the at least two sealing grooves that seal an inside wall of the tubular column, wherein the top of inner pipe is connected to the sucker rod pump through a connecting coupler, the connecting coupler is disposed inside the tubular column, and a bottom end of the tubular column is occluded by an occluder, wherein the positioning flange is positioned inside the tubular column to restrict the inner pipe from moving up, wherein when pumping the oil, the occluder is opened for oil to flow into the tubular column, and the outer oil inlet borings are aligned with the inner oil inlet borings for the oil to flow in during pumping, wherein prior to well maintenance, the inner pipe is lifted up to meet with the positioning flange so that the at least two sealing grooves on the inner pipe with the sealing rings installed thereon keep the outer oil inlet borings occluded.

2. The method of claim 1, wherein the inner pipe defines up to 5 sealing grooves.

3. The method of claim 1, wherein at least one sealing ring is a flexible wear resistant ring.

* * * * *